United States Patent [19]

Strong et al.

[11] 4,172,371

[45] Oct. 30, 1979

[54] JACK BAR ASSEMBLIES

[75] Inventors: Barry C. Strong, Syston; Eric W. Marriott, Shepshed; William Clayton, Leicester, all of England

[73] Assignee: William Cotton Limited, England

[21] Appl. No.: 942,631

[22] Filed: Sep. 15, 1978

[30] Foreign Application Priority Data

Sep. 17, 1977 [GB] United Kingdom ..... 38846/77

[51] Int. Cl.[2] ..... D04B 15/06; D04B 15/24; D04B 27/02

[52] U.S. Cl. ..... 66/109

[58] Field of Search ..... 66/109, 110, 82 R, 90

[56] References Cited

U.S. PATENT DOCUMENTS

| | | | |
|---|---|---|---|
| 1,841,704 | 1/1932 | Bock | 66/110 X |
| 2,580,620 | 1/1952 | Vaclavik | 66/110 |
| 2,722,815 | 11/1955 | Wickardt | 66/110 |
| 2,892,332 | 6/1959 | Kohler et al. | 66/110 |
| 2,904,979 | 9/1959 | Robertson | 66/110 |

*Primary Examiner*—Ronald Feldbaum

*Attorney, Agent, or Firm*—Robert E. Burns; Emmanuel J. Lobato; Bruce L. Adams

[57] ABSTRACT

In a jack bar assembly for a straight bar knitting machine, a pair of jacks is used for each jack-operated sinker. A first jack mounted on a first pivot has a rear edge engaged by the slurcock. A second jack mounted on a second pivot has a rear edge engaged by a nose of the first jack and a nose which engages and actuates the sinker. An increased mechanical leverage provided by the cooperating first and second jacks permits reduction in the advance provided by the slurcock and faster smoother operation.

10 Claims, 4 Drawing Figures

JACK BAR ASSEMBLIES

FIELD OF INVENTION

The invention relates to jack bar assemblies for use on straight bar knitting machines (such as Cotton's Patent type machines).

BACKGROUND OF THE INVENTION:

On straight bar knitting machines bearded needles are mounted on a common needle bar which causes all the needles to move simultaneously during a knitting operation. Jacks of jack bar assemblies are used to advance sinkers in a predetermined manner successively between adjacent needles so as to form kinks of yarn. The jacks are actuated by a slurcock.

In known straight bar knitting machines, a slurcock engages jacks midway at their rear. The slurcock cams the jacks forward and the jacks in turn slide sinkers forward on a sinker bar. The slurcocks have an increasingly steep profile so that the sinkers are advanced rapidly at the final part of their advance. Such sinker actuating systems, using slurcocks and jacks are noisy, subject to wear and may malfunction at high draw speeds (that is the speed of slurcock traverse along the rear of the jacks).

SUMMARY OF THE INVENTION

It is the object of the invention to provide a jack assembly providing a smooth operation and capable, if required, of use with high draw speeds.

According to the invention, the jacks operate in pairs so that one jack receives an input of motion from the slurcock and engages the other jack of the pair which in turn imparts motion to the sinker. Thus the one jack can be arranged to cooperate optimally with the slurcock which moves sideways with respect to the jacks whilst the sinker operating jack can be arranged for efficient motion in the plane of the jacks.

DESCRIPTION OF THE INVENTION

According to the invention there is preferably provided a jack bar assembly comprising first jacks mounted on a first pivot and engageable at a rear edge by a slurcock, second jacks mounted on a second pivot and engageable at a rear edge by the respective associated first jacks for advancing an associated sinker. Thus the sinkers are advanced as a result of pivotal movement of at least two cooperating, independently pivoted jacks. Preferably two jacks only are used, the first jacks serving to engage the slurcock and the second jacks to engage the associated sinker.

It has been found surprisingly that, in spite of an increase in operating parts, such jack assemblies can be used to provide a sinker actuating system operable at high speed and/or with reduced noise. It becomes feasible to reduce advance provided by the slurcock and increase mechanical leverage provided by the cooperating first and second jacks. Wear on the jack pivots may be reduced.

Preferably the first jack is mounted on the first pivot at one end, has a nose for engaging the second jack at the other end and forms a bluged rear edge for engaging the slurcock substantially midway of the nose and the first pivot. Suitably then the second jack is mounted on the second pivot at one end of the second jack substantially level with the bulged rear edge of the first jack, has a nose for engaging the sinker at the other end and forms a bluged rear edge for engaging the nose of the first jack substantially midway between the second jack nose and the second pivot. Thus the sinker advance provided by the second jack nose is from 3 to 5 times preferably 4 times the advance of the bluged rear edge of the first jack when engaged by the slurcock. As the number of sinkers in the process of being advanced at any time need not be changed at high speed, the extent of the slurcock lift can be halved compared with conventional slurcocks engaging a single jack at a leverage of 3. It has been found that at a leverage of approximately 3 smooth operation may be achieved whilst measuring a stable amount of yarn. That is to say the amount of yarn drawn (which governs the stitch length) is substantially unaffected by the speed of slurcock traverse which may be low when operating manually and high when operating under power. At leverages of 4 operation is smooth under power at high speed but the amount of yarn measured may not always be the same.

The first and second jacks may be accommodated in a compact manner, being behind and below a sinker bar and above a head rail, by making the first and second jacks of similar dimensions and arranging them substantially parallel and upright. Advantageously, the second pivot is substantially at the same level as the slur bar and the first pivot is below the level. Thus both pivots are located close to one another and the head rail. The jacks may be optimally designed and mounted for their respective functions, the first jacks being arranged to absorb the sideways force exerted by the slurcock without risk of misalignment between second jacks and associated sinkers. The first and second jacks thus may have each a reduced cross-section having regard to conventional jacks. Preferably the jacks are mounted between jack walls arranged so as to expose the tips of the second jacks and a rear edge part of the first jacks only. Thus the first jacks engage the second jacks at a position between the jack walls so reducing the risk of their misalignment and jack malfunction.

Conveniently the first and second jacks are arranged so that the leverage increases towards the end of the pivotal movement of the jacks.

Preferably the first jack is adapted to engage a jack spring both in its forward and its retracted position by providing a pair of spaced bevel edges at the top of the first jack. This permits mounting of a jack spring bar over a slur bar.

The jacks may be of small size, be rigid and of small inertia and be advanced at high slurcock traverse speeds.

DESCRIPTION OF THE PREFERRED EMBODIMENT

Figure 1:
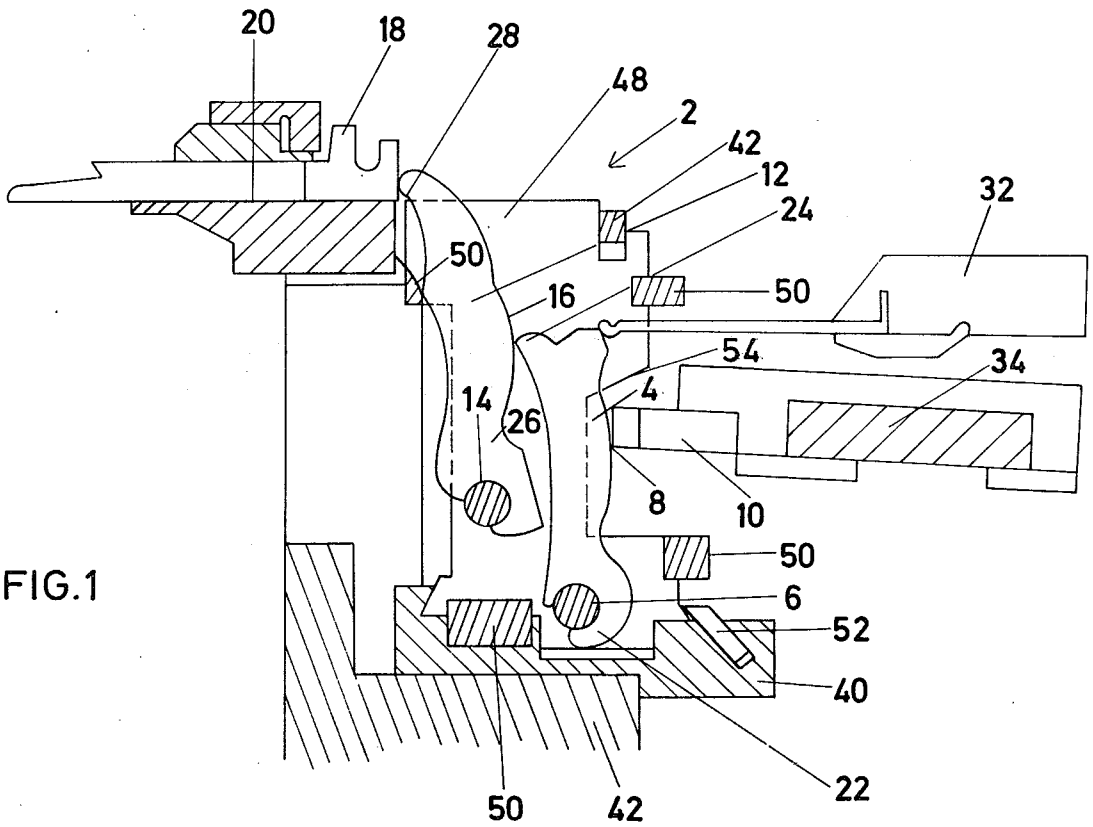
FIG. 1 shows a second through jack bar assembly according to the invention associated with a head-rail sinker bar assembly and slur bar assembly, the jacks being fully advanced.
Figure 2:
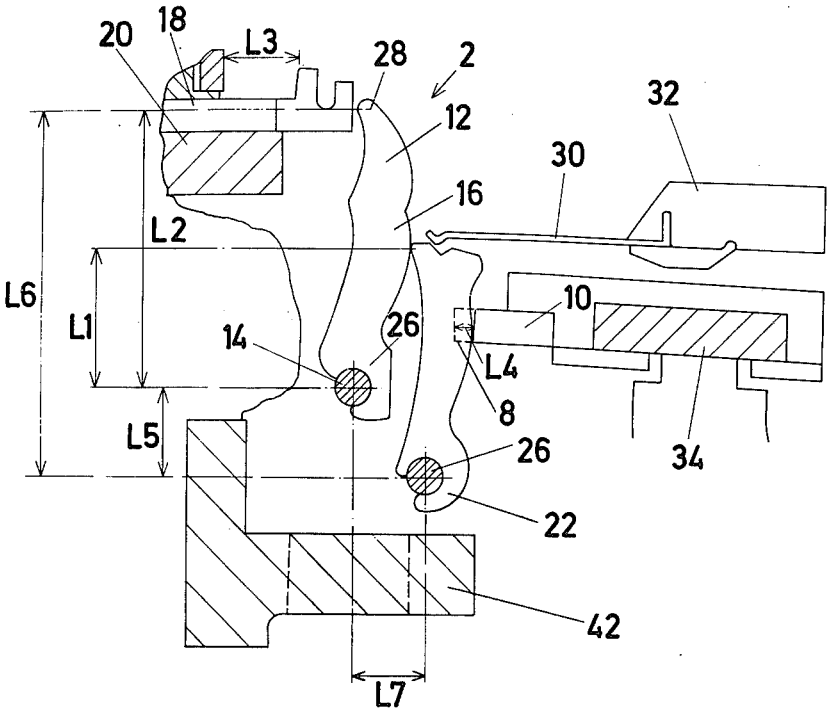
FIG. 2 shows a section through part of FIG. 1 with the jacks fully retracted.
Figure 4:
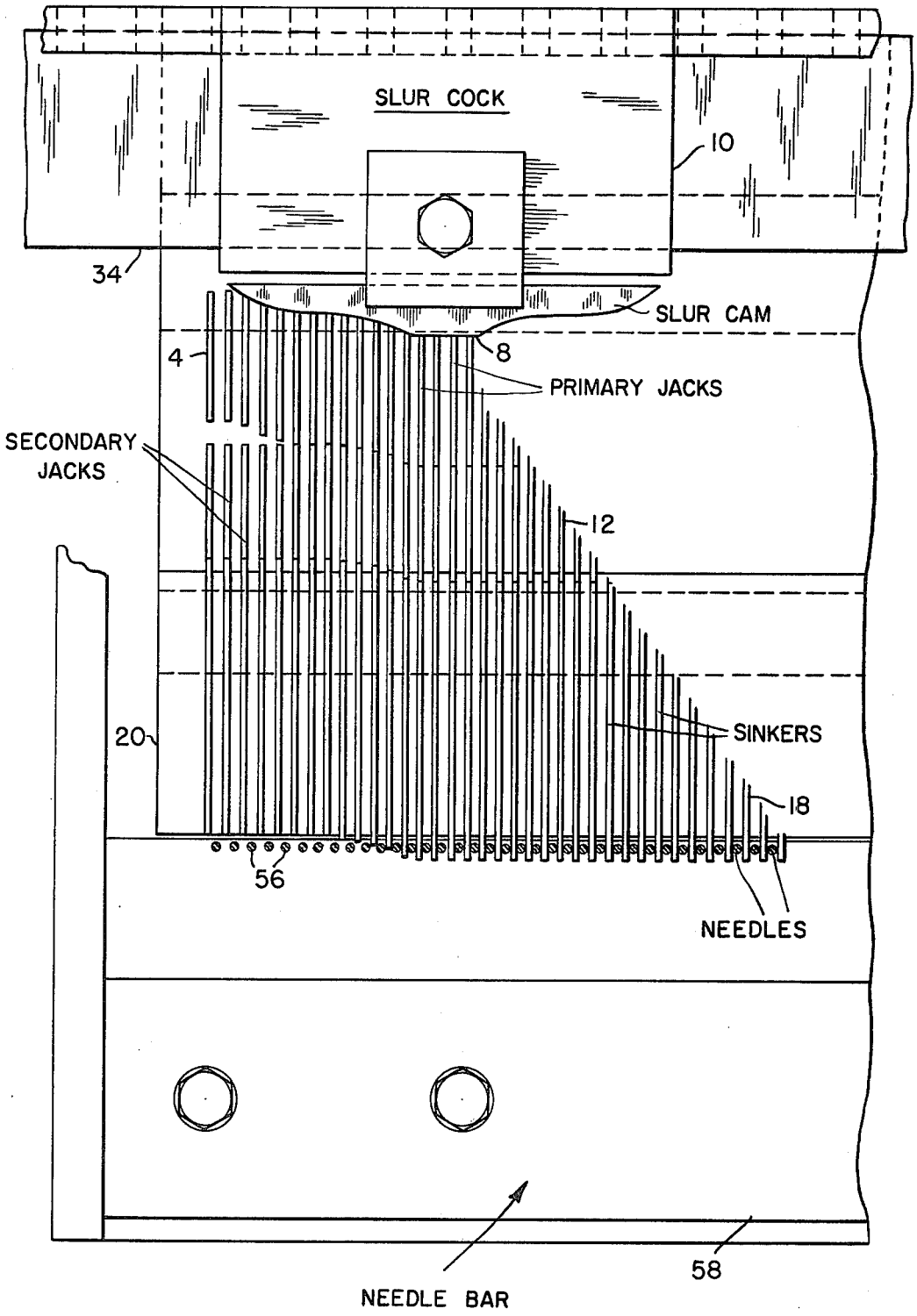
FIG. 4 is a schematic partial plan showing the sinkers, jacks and slurcock.

With reference to the FIGS. 1, 2 and 4 a jack bar assembly, generally indicated at 2, has primary jacks 4 mounted on a longitudinally extending pivot wire 6. The jacks 4 have a rear edge forming a bluge at 8 engaged by a slurcock 10 which is reciprocable in usual manner on a slur bar 34. Suitable means for driving the slurcock is described in Max C. Miller "Knitting Full-Fashioned Hosiery" published by McGraw-Hill Book Company, New York, N.Y. The assembly 2 further has secondary jacks 12 mounted on another longitudinally extending pivot wire 14. The jacks 12 have a rear edge with a curved part at 16. Each pair of associated primary and secondary jacks 4 and 12 cooperate to actuate a sinker 18 slidably mounted in a sinker bar 20. Sinker 18 penetrate between adjacent needles 56 carried by a needle bar 58 as illustrated in FIG. 4.

The primary jacks 4 have pivot portions 22 with a central aperture for holding the pivot wire 6 at one end and noses 24 at the other end which bear against the curved parts 16 of the rear edges of the jacks 12 at other end. The secondary jacks 12 have pivot portions 26 at one end and noses 28 for engaging the sinkers 18 at the other end. The noses 24 engage the curved parts 16 halfway between the ends of the jacks 12.

FIG. 2 shows the proportions in more detail, L1 being about half of L2. The leverage obtained is the ratio of sinker advance L3 over the slurcock advance L4. In this case a leverage of 3 is obtained. The leverage may be varied if required by raising or lowering the slur bar 34 with respect to the primary jacks 4.

The high leverage can be obtained with a jack assembly of dimensions similar to conventional ones which use only one jack to actuate each sinker and have a leverage of about 2. L5 shows the vertical spacing of the pivot wire 6 and 14, which is only a small part of the overall vertical spacing L6 between the lower pivot wire 6 and the uppermost nose 28. The horizontaspacing L7 between the pivot wire 6 and 14 is small.

The primary jacks 4 have bevelled edges at angularly spaced positions along the top edges for engaging jack springs 30 in the forward position (See FIG. 1). No shifting of the jack springs 30 in a horizontal sense is required.

The jack bar assembly 2 can be compactly accommodated to the rear of the sinker bar 20, above the head rail 42 and in front of a jack spring bar 32 and a slur bar 34.

The jacks 4 and 12 can be retained in the jack bar assembly 2 in appropriate register with the sinkers 18 by a housing comprising a jack bar base 40 attached to the head rail 42, jack bar pillars (not shown) being provided at each end of the jack bar base 40. The jack pillars mount the ends of the pivot wires 6 and 14, alignment bars 41 and trick cut bars 50 which serve to locate one jack wall 48 between each pair of jacks 4 and 12. To avoid obscuring the drawing, jack walls are not shown in FIG. 4. The jack walls 48 are held onto the base 40 by a clamping plate 52 and each have a recess 54 to enable the slurcock 10 to pass along the rear of the jacks 4.

Figure 3:
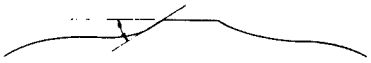
FIG. 3 shows a profile of slurcock for use with the jack bar assembly of FIGS. 1 and 2.

The slurcock profile (adapted for a leverage of 3) is shown in FIG. 3. Using the high leverage, the slope $\alpha$ at the forward extremity of the slurcock 10, which is the steepest part of the profile, can be made small. The slurcock engages the jacks 4 about halfway between the pivot 14 and the nose 24. The jack bar may provide a set of first and second jacks for every sinker.

What is claimed is:

1. Jack bar assembly for transmitting motion from a slurcock to sinkers of a straight bar knitting machine, said assembly comprising for each of said sinkers, a primary jack movable about a pivot and actuated by engagement with said slurcock, and a secondary jack movable about a pivot and actuated by said primary jack, said secondary jack transmitting movement from said primary jack to said sinker.

2. Jack bar assembly according to claim 1, wherein said primary jack has a rear edge portion engaged by said slurcock and a nose portion engaging said secondary jack, and in which said secondary jack has a rear edge portion engaged by said nose portion of said primary jack and a nose portion engaging said sinker.

3. Jack bar assembly according to claim 2, wherein said rear edge portions of said primary and secondary jacks are convex.

4. Jack bar assembly according to claim 1, further comprising jack walls disposed between successive pairs of primary and secondary jacks and retaining the primary jack and secondary jack of each pair of jacks in mutual alignment in a common plane.

5. Jack bar assembly according to claim 1, wherein said primary jack and second jack are pivoted about different pivots which are spaced from one another.

6. Jack bar assembly according to claim 1, wherein said secondary jack amplifies the movement transmitted to said primary jack by said slurcock.

7. Knitting head assembly of a straight bar knitting machine comprising a sinker bar assembly, a jack bar assembly, and a draw assembly including a slurcock, said sinker bar assembly comprising a sinker bar and sinkers slidable in said sinker bar, and said jack bar assembly comprising for each sinker, a pair of jacks comprising a primary jack mounted on a first pivot and having a nose portion and a rear edge portion engageable by said slurcock to move said primary jack about said pivot, and a secondary jack mounted on a second pivot and having a nose portion engaging the respective sinker and a rear edge portion engaged by the nose of said primary jack to move said secondary jack about its pivot and thereby transmit movement from said primary jack to said sinker.

8. Knitting head assembly according to claim 7, wherein said first and second pivots are spaced from one another.

9. Knitting head assembly according to claim 7, wherein said secondary jack amplifies movement imparted to said primary jack by said slurcock, the rates of the travel of said sinker to the travel of said rear edge portion of said primary jack engaged by said slurcock being of the order of 2.5:1 to 3.5:1.

10. Knitting head assembly according to claim 7, further comprising jack walls disposed between successive pairs of primary and secondary jacks and retaining the primary jack and secondary jack of each pair of jacks in mutual alignment in a common plane.

* * * * *